US006799955B1

(12) United States Patent
Sbarounis

(10) Patent No.: US 6,799,955 B1
(45) Date of Patent: Oct. 5, 2004

(54) TWO-LOBE ROTARY MACHINE

(76) Inventor: Joaseph A. Sbarounis, 138 Prince St., Apt. 1, Boston, MA (US) 02113

( * ) Notice: Subject to any disclaimer, the term of this patent is extended or adjusted under 35 U.S.C. 154(b) by 0 days.

(21) Appl. No.: 10/628,658

(22) Filed: Jul. 28, 2003

(51) Int. Cl.[7] ..... F01C 1/02
(52) U.S. Cl. ..... 418/54
(58) Field of Search ..... 418/54, 61.2

(56) References Cited

U.S. PATENT DOCUMENTS

| | | | |
|---|---|---|---|
| 298,952 | A | 5/1884 | Donkin |
| 1,340,625 | A | 5/1920 | Planche |
| 3,800,760 | A | 4/1974 | Knee |
| 3,938,919 | A | 2/1976 | Huf et al. |
| 3,966,370 | A | 6/1976 | Huf |
| 4,300,874 | A | 11/1981 | Georgiev |
| 4,345,886 | A | 8/1982 | Nakayama et al. |
| 5,393,208 | A | 2/1995 | Sbarounis |

FOREIGN PATENT DOCUMENTS

| | | | |
|---|---|---|---|
| GB | 258 | * of 1853 | 418/54 |

* cited by examiner

*Primary Examiner*—John J. Vrablik
(74) *Attorney, Agent, or Firm*—Fitch, Even, Tabin & Flannery

(57) ABSTRACT

A rotary machine including a housing with spaced apart end walls defining a chamber. A two-lobe lenticular rotor assembly is disposed in the chamber for eccentric rotation therein. A hole passes through a central portion of the rotor assembly. Slots are cut in one end of the rotor assembly about the center of the rotor assembly. A rotor guide assembly includes generally cylindrical guideposts which extend parallel toward the slots and engage in eccentric rotation of the slots. A shaft extends through the center of the hole. In one embodiment an even number of six or more spaced slots and half that number of guideposts spaced around the shaft are used which allows for a larger sized hole and shaft. In another embodiment, four slots which are shifted toward the apices of the rotor, and two guideposts are used, which also allows for a larger sized hole and shaft.

29 Claims, 13 Drawing Sheets

TWO-LOBE ROTARY MACHINE

FIELD OF THE INVENTION

The present invention relates generally to a rotary machine. More particularly, the present invention relates to a two-lobe rotor rotary machine having fixed guide members for positioning the rotor apices while rotating a shaft or for being driven by a rotating shaft.

BACKGROUND OF THE INVENTION

The concept of rotary machines operating as positive displacement machines, e.g., either pumps or engines, date back for several hundred years. For example, U.S. Pat. No. 1,340,625 teaches a rotary machine having a two-lobe lenticular rotor provided with two slots. One of these is in line with the rotor apexes and the other is perpendicular to this and has a center passing through the rotor center which engage fixed guide members mounted on the machine housing. The slotted rotor construction requires that the machine's rotating shaft be supported completely from one side of the rotor. However, for high torque and high speed rotary machines, considerable stresses necessitate that the single shaft support bearing be substantial, i.e., heavy. In addition, the configuration offered an advantage over the gear in the fabrication but was not more compact in size.

In U.S. Pat. No. 4,300,874, a rotary machine includes a slotted rotor for engagement with a large single guide member and a rectangular portion of the shaft that passes therethrough. A first slot accommodates the guide member and a second slot perpendicular to the first slot accommodates the rectangular portion of the shaft. The rotor slidingly contacts the guide member and the rectangular portion of the shaft during eccentric rotation. However, centrifugal forces from the eccentric motion of the rotor are transmitted in alternate fashion between the guide member and the rectangular portion of the shaft thereby causing forces to be concentrated at the various points of contact. This is the source of friction and wear as rotational speed increases.

The applicant's prior U.S. Pat. No. 5,393,208 disclosed a rotary machine having a two-lobe lenticular rotor assembly. The rotor has two slots at right angles passing through the center of the rotor however there is a bole through the central portion thereof creating the appearance of four slots cut in one end of the rotor in a symmetric arrangement about the center of the rotor. A rotor guide assembly is provided with two guideposts that engage the slots during eccentric rotation of the rotor assembly. A shaft is provided which passes through the hole in rotor positioning mechanism. This type of rotor positioning mechanism has no contact stresses while operating at a rotational speed in a vacuum while having the rotor supported by a shaft which passes through the rotor positioning mechanism.

It is recognized that an engine of a more compact size in a durable configuration would be useful. Some useful criteria are to have the surfaces of the engine exposed to working medium that have sliding contacts with no force interactions and to have a higher displacement volume compared to the total volume of the machine. The creation of a rotor positioning mechanism operating with only a pressure seal at the side of the rotor and lubrication seals on the shaft was a primary goal of this effort. This concept combined with the longer stroke allows for a device that can replace turbo machinery in many applications.

It has also been recognized that a cyclic thermodynamic process as is possible with piston configurations are inherently more efficient in many instances. This would be found to be the case, for example, if one were to compare the air standard Brayton cycle to the modified Otto cycle having full expansion to the inlet pressure.

SUMMARY OF THE INVENTION

The present invention provides for a two-lobe rotary machine capable of functioning either as a pump, engine, or impellor. The improvement for the two-lobe rotary machine allows for a larger shaft to be used for a given sized rotor, or a smaller rotor for a given sized shaft.

The improvement can also be used to increase the volume that may be displaced by the rotary machine as compared to the overall size and mass of the rotary machine, since the rotor crank length or stroke is increased. This results in a rotor assembly that allows the machine to be more compact than if used with internal gears or slots at right angles to keep the rotor apexes in proximity of the inner portion of the outer housing. The machine will thus operate at lower pressure differentials for a given amount of torque on the shaft.

The rotor may also act as an impellor for liquids or gases when not fully enclosed in a housing.

The invention will become more apparent in the following description and drawings.

The present invention provides a rotary machine comprising: a housing with spaced apart end walls for defining a chamber; an elliptical or lenticular two-lobe rotor assembly having curved faces meeting at symmetrically opposed apexes or two lobe rotor with curved faces transitioning to fluidic or aerodynamic surfaces, said rotor assembly having two parallel end faces extending between said curved faces, each of said parallel end faces facing one of said end walls, said rotor assembly disposed in said chamber for eccentric rotation therein, said rotor assembly having a hole in a central portion of the rotor assembly and a shaft having a shaft center longitudinal axis, said shaft center longitudinal axis being offset from said rotor assembly center longitudinal axis by an offset distance $R_{C1}$, said shaft including at least one eccentric bearing for forming driving contact between said shaft and said rotor assembly;

a rotor with an even number of twelve or more straight cam surfaces arranged about a rotor assembly center longitudinal axis; the straight cams having orientation such that half the straight cam surfaces radially oppose the remaining straight cam surfaces;

straight edges being parallel to line perpendicular to longitudinal axis of eccentric portion of shaft at a distance of Rp;

a rotor guide assembly extending from at least one of said end walls, the rotor guide assembly having six or more arc shaped cams, half of said arc shaped cams radially oppose remaining arc shaped cams, a distance from said shaft center longitudinal axis to each of said arc center longitudinal axes being equal to an offset distance $R_{C2}$, said rotor guide member assembly including cam surfaces extending in parallel fashion through one of said parallel end faces for engagement with said twelve or more straight cams during said eccentric rotation of said rotor assembly, each of said guide members having a surface with a partially circular perpendicular cross-sectional shape over a portion thereof which engages said straight cam, rotor guide member assembly having approximately half of guide member arcs radially opposing remaining guide member arcs, both sets of opposing guide member arcs having maximum angle between adjacent circular arc longitudinal center of less than 180 degrees;

wherein each of said arc shaped cams and straight cams are sized, shaped, and configured for engagement with said guide member arcs during eccentric rotation of rotor assembly.

Alternatively, a rotor with an even number of eight or more straight cam surfaces arranged about a rotor assembly center longitudinal axis; the straight cams having orientation such that half the straight cam surfaces radially oppose the remaining half of the straight cam surfaces;

straight edges being parallel to line perpendicular to longitudinal axis of eccentric portion of shaft at a distance of Rp;

a rotor guide assembly extending from at least one of said end walls, the rotor guide assembly having four or more arc shaped cams, half of said arc shaped cams radially oppose remaining arc shaped cams, a distance from said shaft center longitudinal axis to each of said arc center longitudinal axes being equal to an offset distance $R_{C2}$, said rotor guide member assembly including cam surfaces extending in parallel fashion through one of said parallel end faces for engagement with said eight or more straight cams during said eccentric rotation of said rotor assembly, each of said guide members having a surface with a partially circular perpendicular cross-sectional shape over a portion thereof which engages said straight cam, rotor guide member assembly having approximately half of guide member arcs radially opposing remaining guide member arcs, both sets of opposing guide member arcs having maximum angle between adjacent circular arc longitudinal center of greater than 180 degrees; and wherein each of said arc shaped cams and straight cams are sized, shaped, and configured for engagement with said guide member arcs during eccentric rotation of rotor assembly.

DETAILED DESCRIPTION OF THE PREFERRED EMBODIMENTS

The present invention allows for a stronger shaft to be used for a rotor described by the applicants U.S. Pat. No. 5,393,208 having a given crank length, or a shorter crank length to be used for a given shaft strength. The significance of this being that at higher pressures, a larger shaft is more able to withstand the predominantly torsional stress exerted on it by the rotating rotor.

An alternative improved configuration allows for the crank length to be increased for a given sized rotor loosely defined as the distance between rotor apex contacts with the outer housing. The longer crank length for a given sized rotor, torque on the shaft, and rotor axial length results in lower operating pressures, bearing loads, and reduced losses in the pressure seals. Crank length is defined as that distance between the eccentric bearing center and the longitudinal center of the shaft.

If the shaft is to be supported on both sides of the rotor then the size and strength of the shaft for any given crank length is limited by the size of the passage through the rotor positioning mechanism that the shaft must pass. It will be shown that this is dependent on the minimum angle between fixed cam arcs as measured from the input/output shaft longitudinal center and the fixed cam arc radius for a given crank length. There is defined a maximum shaft radius and cutout portion of the shaft for clearance. The characteristics of the cutout portion of the shaft have a significant effect on the shaft torque handling capacity.

Figure 1:
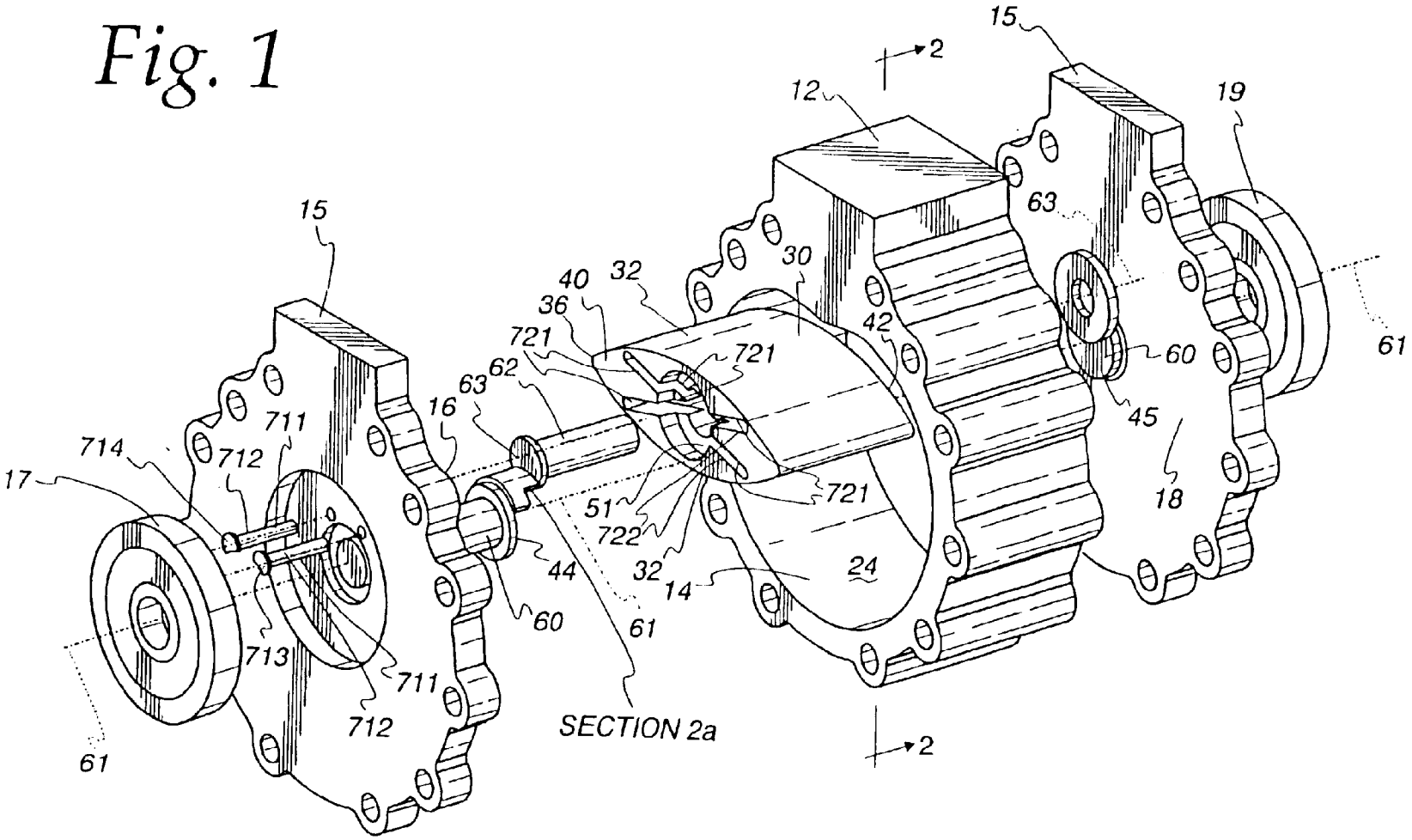
FIG. 1 is an exploded perspective view of a rotary piston machine according to the present invention.
Figure 2A:
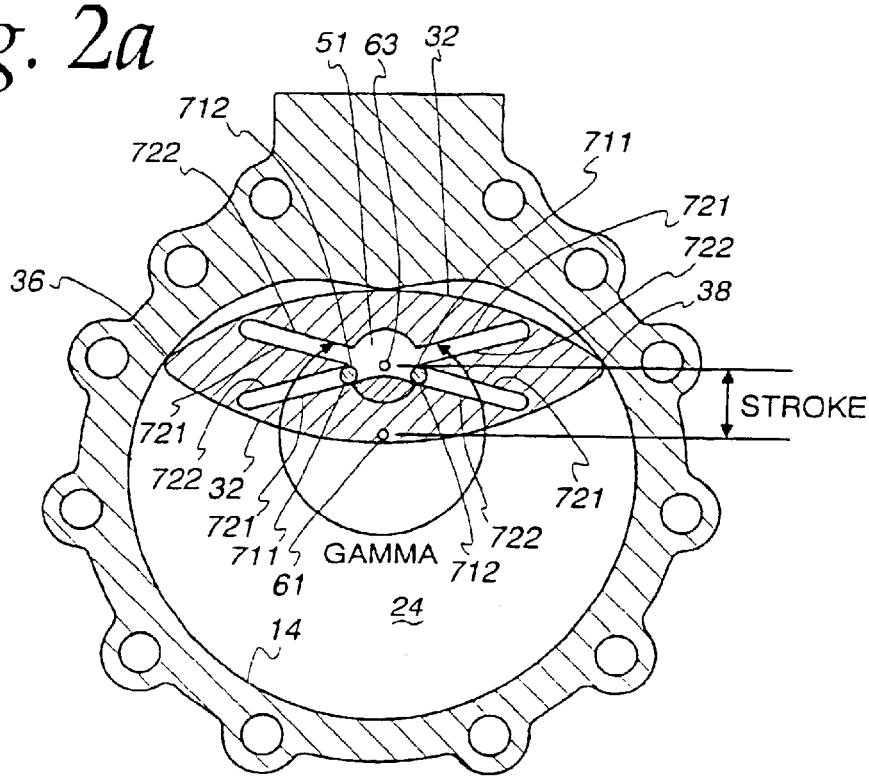
FIGS. 2*a*–2*d* are cross-sectional views taken along the line 2—2 of FIG. 1 and showing successive operating positions.
Figure 2B:
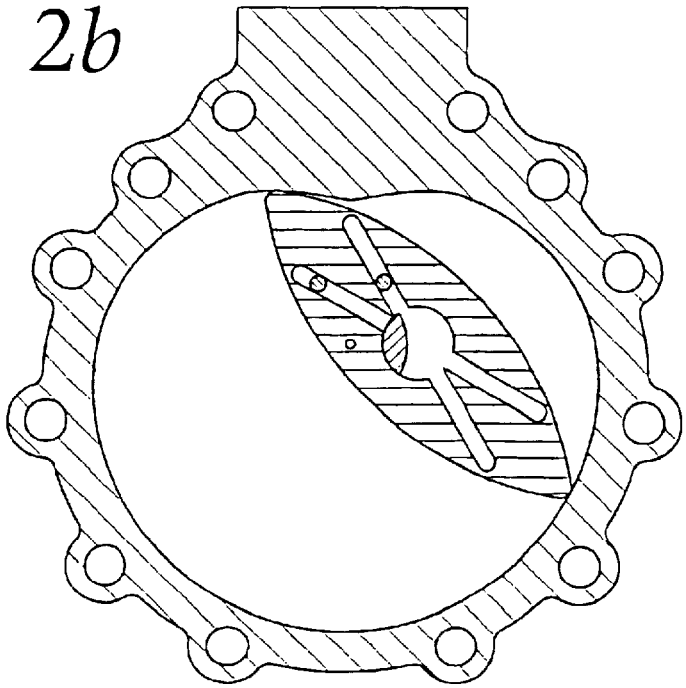
Figure 2C:
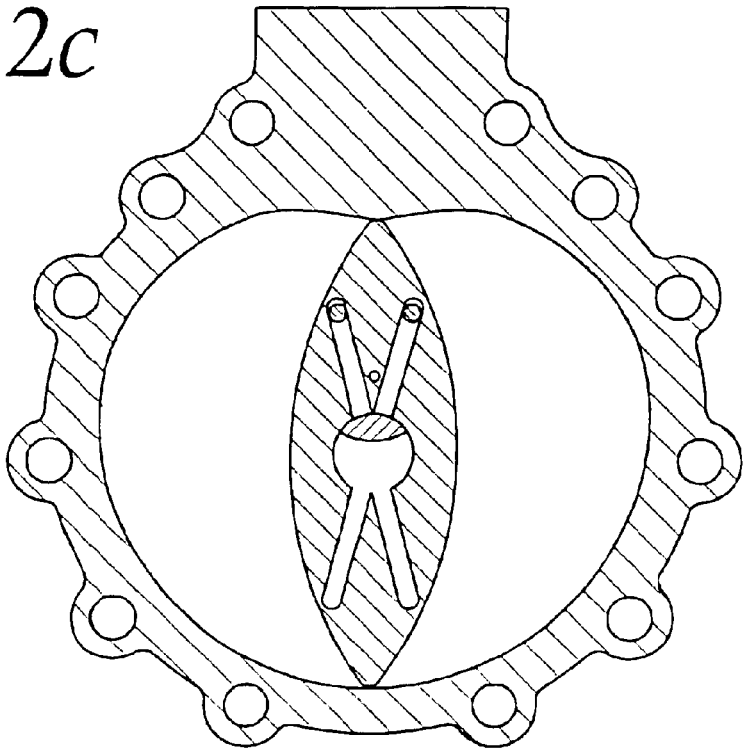
Figure 2D:
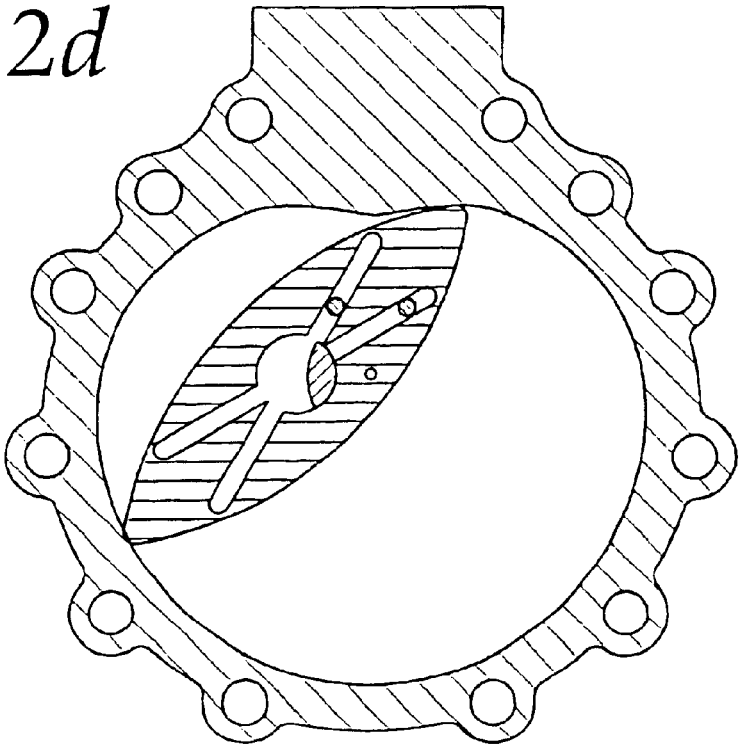

FIG. 1 shows a first embodiment of the present invention having outer housing 12 with inwardly facing annular wall 14. The first embodiment also includes side housings 15 having inwardly facing end walls 16 and 18 which when joined together with housing 12 create machine chamber 24. Rotor assembly 30 is disposed in machine chamber 24 for eccentric rotation within. Rotor assembly 30 has apexes 36, 38 that form a pressure seal with annular wall 14 by being positioned in close proximity with annular wall 14 by a rotor positioning mechanism. A pressure seal is also formed between rotor end faces 40 and 42 and end walls 16, 18. An additional seal not necessary for the operation of the mechanism is formed by inwardly facing shaft seals 44, 45 and end faces 40 and 42 that seal chamber 24 from the rotor positioning mechanism. This is due to curved faces 32 of this embodiment not encompassing the shaft longitudinal center 61. Eccentric bearing 62 of shaft 60 forms driving contact between shaft 60 and rotor assembly 30.

It is to be understood that the first embodiment represents a positive displacement machine where the passage of fluids or gases into and out of chamber 24 can be implemented in any one of a variety of ways. Accordingly, discussion and description relating to this aspect will be omitted.

A set of four leading straight cams 721 and four trailing straight cams 722 embedded within rotor 30 are shifted toward the apexes 36, 38. A set of two leading cam arcs 711 and a set of two trailing cam arcs 712 are mounted within at least one of side housings and shifted towards the top dead center portion of the housing. The cam arcs shown in FIG. 2 are shown as cylindrical and concentric, but for the general description to be provided, these will be broken down into individual cam arcs. The distance of cam arc centers 713, 714 from shaft longitudinal center 61 is equal to the crank length and the maximum angle "gamma" between adjacent cam arc centers 713, 714 measured from the shaft longitudinal center 61 is now greater than 180 degrees. This allows for a much larger crank length or stroke relative to the size of the rotor, however, a large portion of the shaft 60 is "cutout" to fit the shaft 60 within the hole 51. The first embodiment of FIG. 1 and FIG. 2 depicts a crank length approaching the maximum possible for passage of the shaft 60 through the rotor positioning mechanism while maintaining engagement of the guide cam assembly at all angles of shaft rotation. As can be seen, for strength, the shaft 60 is shown with an additional portion to pass through the hole in rotor end face 40 that does not maintain simultaneous engagement of cams. It should be noted that the minimum radius of simultaneous engagement of area 51 is a design parameter that will be described and that the rotor in the position near top dead center position can have the rotor positioned by contact of the apexes 36, 38 with housing annular wall 14.

FIG. 2 is a frontal view of the cutout section of FIG. 1 showing the rotary position in successive positions. Position 2A shows the point of contact of the cam surface at a maximum distance from eccentric bearing longitudinal axis 63 for either cam while both cam surfaces are maintaining contact. This will be described in greater detail in the second embodiment.

Figure 3:
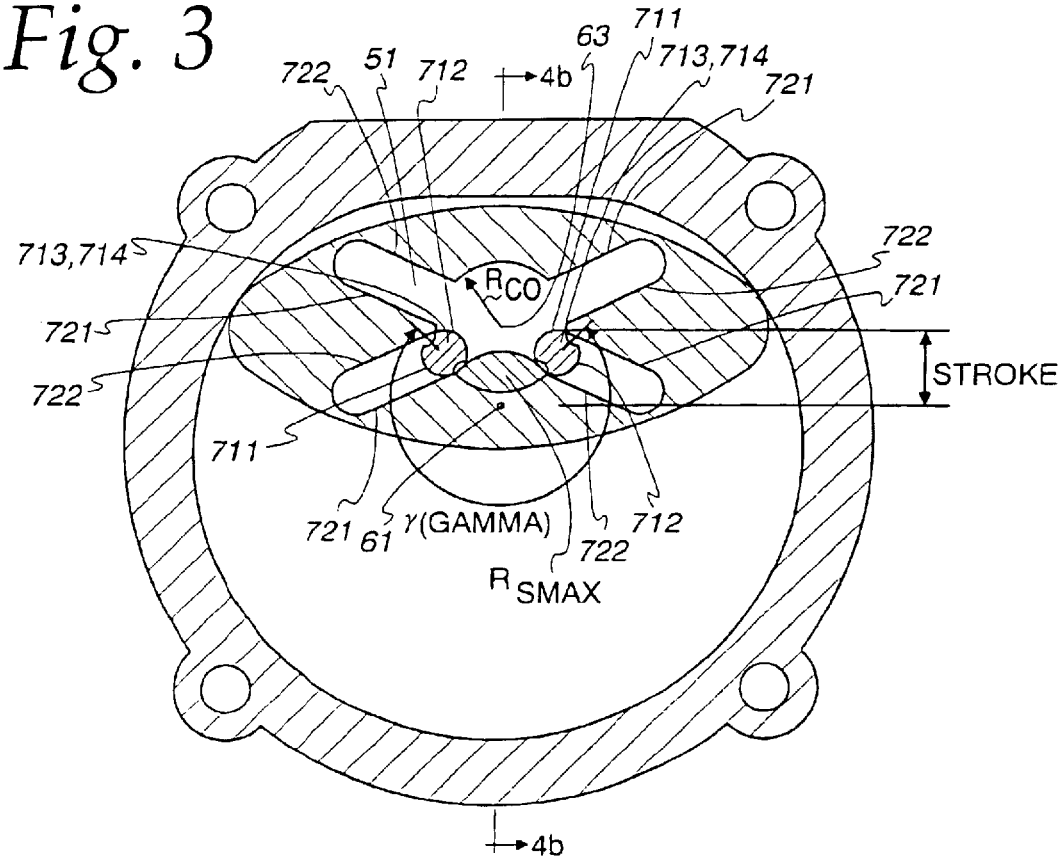
FIG. 3 is a cross-sectional view taken along line 3—3 of FIG. 4*a;*

FIG. 3 is an embodiment similar to FIG. 1 with like numerals used for the cams. FIG. 3 and shows only a section cutting through the cam simultaneous engagement region. There is a guide member assembly having a leading set of two cam arcs 711 and trailing set of two cam arcs 712. There is in the rotor a straight cam assembly having a leading set of four straight cam surfaces 721 and a trailing set of four straight cam surfaces 722. The cam arc centers 713, 714 are equidistant from the shaft longitudinal center 61, and for the purpose of simplicity the cam arc centers 713, 714 are arranged symmetrically with cam arc centers 713 and arc centers 714 aligned. It will be shown that the maximum angle "gamma" between two adjacent cam arc centers 713 or 714 and the radius of the cam arc 711 or 712 will determine the maximum radius of simultaneous engagement relative to the crank length. This is the maximum radius through which the shaft may pass with clearance to rotate and also the minimum lever arm creating a force between arc cams 711, 712 and straight cam 721, 722 as measured from the eccentric bearing center 63. When the maximum angle gamma between cam arc centers 713, 714 as measured from shaft longitudinal center 61 is increased, the minimum radius of engagement of the cams to position the rotor for all angles of shaft rotation decreases. This is accomplished by shifting the straight cams toward the rotor apexes. The effect is to reduce the rotor frontal area significantly or increase the stroke for a given rotor frontal area, however, the distance the straight cam surfaces 721, 722 need to extend radially toward the eccentric bearing center increases corresponding to a decreased minimum radius of engagement. For this embodiment the use of an angle between arc cam centers greater than the 180 degrees can significantly increase the stroke and displacement. There can then be an optimum shaft and cam assembly for a given range of input pressure and flow rate corresponding to a desired output.

Figure 4B:
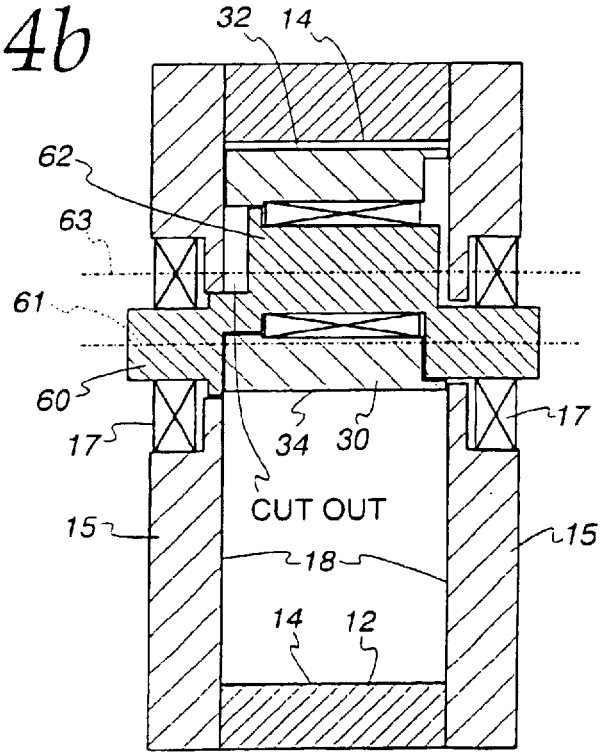
FIG. 4*b* is a cross-sectional view taken along line 4*b*—4*b* of FIG. 3.
Figure 4A:
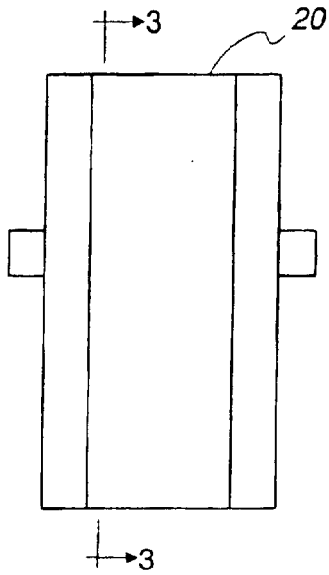
FIG. 4*a* is a side elevational view of the rotary piston machine of FIG. 1.

FIG. 4 shows a view depicting an example of a shaft passing through the cross section of minimum radius of engagement.

Figure 5:
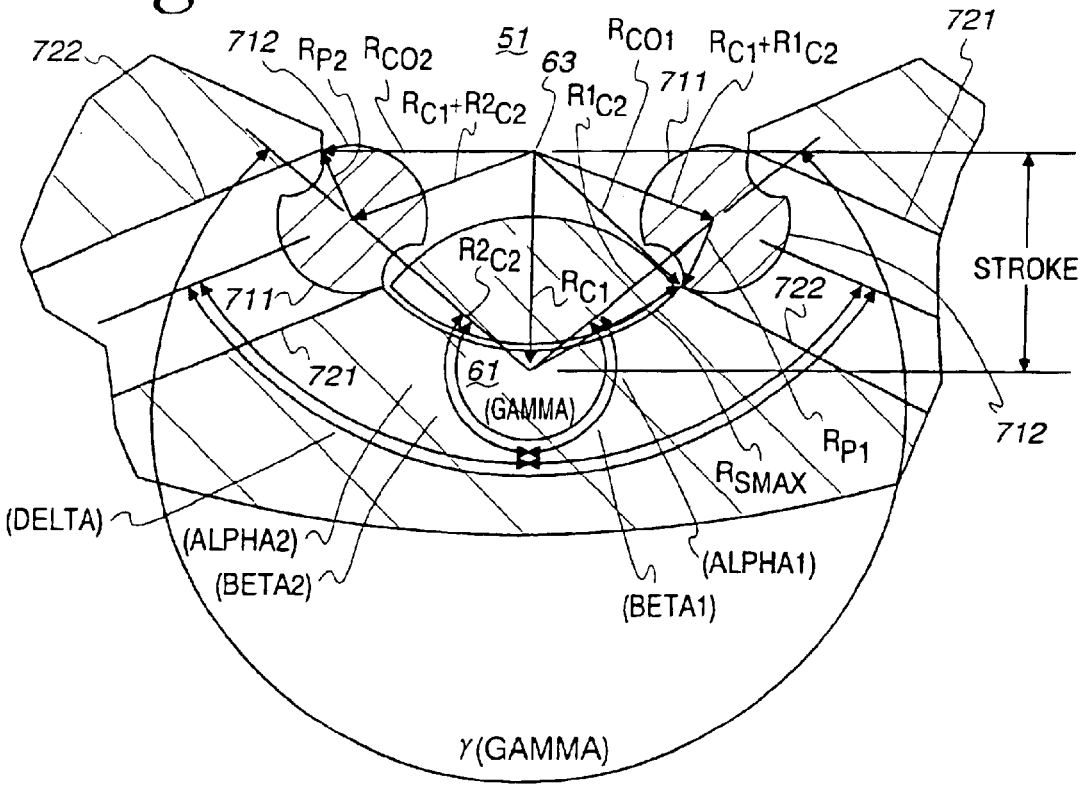
FIG. 5 is a fragmentary view of FIG. 3 taken on an enlarged scale.

FIG. 5 shows an enlarged view of the four-arc cam and eight-straight cam arrangement of FIG. 3. As shown in this figure, $R_{C0}$ is the minimum radius of engagement or radius of the hole 51 measured from the eccentric bearing center 63. $R1_{C0}$ and $R2_{C0}$ are the distances from the eccentric bearing center 63 to the point of engagement of guide cam 712 and straight cam 722. A similar description would follow for cam set 711, 721, however cam set 712, 722 will be described. The minimum radius of engagement for the leading or trailing cam set being $R_{C0}$ is when $R1_{C0}$ and $R2_{C0}$ are equal. There are various techniques to'solve for the minimum $R_{C0}$ from the vectors defining the geometry. $R_{C1}$ is the vector between eccentric bearing center 63 and the shaft longitudinal center 61, this is the crank length of the rotary machine. $R1_{C2}$ and $R2_{C2}$ are vectors between the shaft longitudinal center 61 and the applicable cam arc centers 714 and these vectors are fixed. The radii $R_{P1}$ and $R_{P2}$ of the cam arcs 712 as shown in FIG. 3 are equal, however in a general formulation these are not assumed equal. Alpha1 is the angle between the vector $R1_{C2}$ and $R_{C1}$. Alpha2 is the angle between $R2_{C2}$ and $R_{CP1}$. Alpha1 plus Alpha2 is the angle between $R1_{C2}$ and $R2_{C2}$ defined as gamma. Beta1 can be defined as the angle between the vector ($R_{C1}$+$R1_{C2}$) and $R_{C1}$. Beta2 is defined as the angle between ($R_{C1}$+$R2_{C2}$) and $R_{C1}$. Beta1 plus beta2 is the angle delta between the straight cams 722. The straight cams 722 having the greatest angle delta to one another correspond to the minimum $R_{C0}$ for the configuration. These values have the following relationship:

$$\alpha 1=2\cdot\beta 1$$

$$\alpha 2=2\cdot\beta 2$$

$$\chi=\alpha 1+\alpha 2$$

$$\delta=\beta 1+\beta 2$$

and;

$$|R_{C1}|=|R1_{C2}|=|R2_{C2}|$$

and $R_{CO1}$=and $R_{CO2}$ are;

$$|R_{CO1}| = \sqrt{R_{C1}^2 + R1_{C2}^2 - 2R_{C1}R1_{C2}\cos(180-\alpha 1) + R_{P1}^2}$$

$$|R_{CO2}| = \sqrt{R_{C1}^2 + R2_{C2}^2 - 2R_{C1}R2_{C2}\cos(180-\alpha 2) + R_{P2}^2}$$

The minimum simultaneous engagement radius is when $R_{CO1}$ equals $R_{CO2}$. For the case where $R_{P1}$ equals $R_{P2}$ it can be shown that alpha1 equals alpha2, which is half the angle between cam arc centers 614 measured from the shaft longitudinal center 61. The minimum engagement radius $R_{CO}$ then becomes;

$$|R_{CO1}| = \sqrt{R_{C1}^2 + R1_{C2}^2 - 2R_{C1}R1_{C2}\cos(180-1/2\chi) + R_{P1}^2}$$

Figure 13:
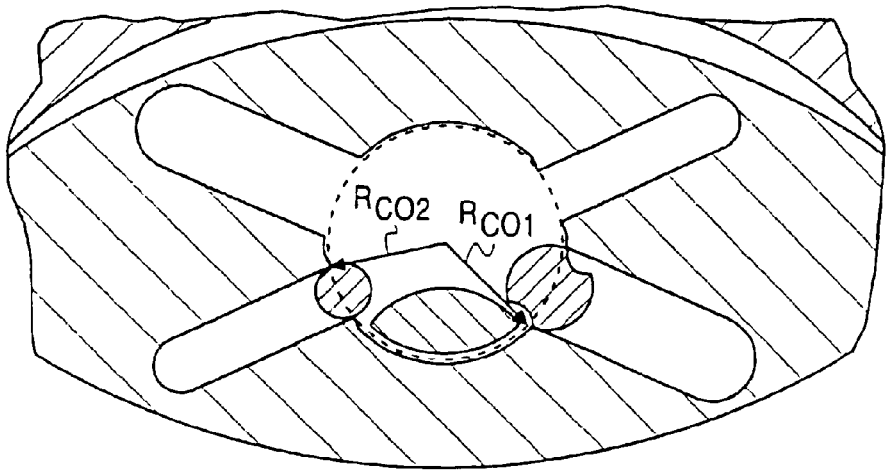
FIGS. 13–16 are fragmentary views similar to FIG. 3 but showing different cam arrangements.

FIG. 13 is an embodiment with different cam arc radii $R_{P1}$ and $R_{P2}$. If $R_{P1}$ and $R_{P2}$ are not equal, then equating $R_{CO1}$ and $R_{CO2}$ allows for the determination of alpha1 and alpha2.

This can be accomplished in closed form or by iteration by several mathematical methods. The value of $R_{CO}$ is found by substituting the corresponding value found for alpha1 or alpha2 in the formula for $R_{CO1}$ or $R_{CO2}$.

Furthermore, the maximum radius of the shaft 60 is represented by $R_{smax}$ wherein:

$$|R_{\max}| = \sqrt{R1_{C2}^2 + R_{P1}^2 - 2R1_{C2}R_{P1}\cos(90-\beta 1)}$$

is the $R_{smax}$ parameter for a shaft passing through that plane of the cam set. In other words, $R_{smax}$ is constrained by the spacing of the slots, the largest spacing being at an angle delta, and the shaft 60 may only be so large to allow unrestricted engagement of the cam arcs 712 with the straight cams 722. The minimum engagement radius does not extend beyond the shaft longitudinal center for the embodiment of FIGS. 2 and 3 so cylindrical shaft could not pass through hole 51.

By shifting the straight cams toward the rotor apexes, the $R_{smax}$ is larger for a given frontal area of the rotor, however the $R_{CO}$ is much smaller resulting in a great deal of material removal from the shaft 60. The very long stroke for the device, however, is able to convert a lower pressure more effectively to output. For example, this can allow for a relatively loose fitting pressure seal to work effectively.

Figure 6:
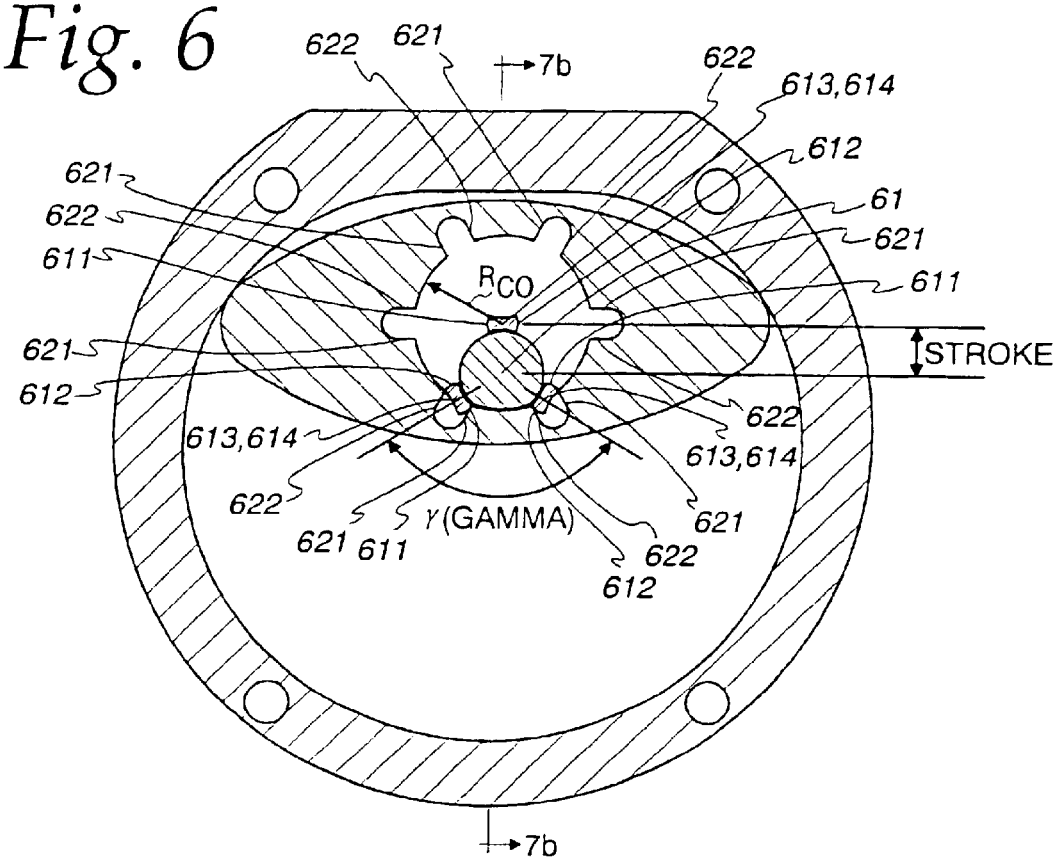
FIG. 6 is a cross-sectional view taken along the line 6—6 of FIG. 7*a;*

FIG. 6 is a third embodiment of the present invention showing only the "cutout" section cutting through the cam non-simultaneous engagement area 51. There is a guide cam assembly having a leading set of three cam arcs 611 and trailing set of three cam arcs 612. There is in the rotor a straight-cam assembly having a leading set of six straight-cam surfaces 621 and a trailing set of six straight-cam surfaces 622. The cam arc centers 613, 614 are equidistant from the shaft longitudinal center 61, and for the purpose of simplicity the cam arc centers 613, 614 are arranged symmetrically with opposing cam arc centers 613 and cam arc centers 614 aligned. It will be shown that the maximum angle "gamma" between two adjacent cam arc centers 613 or 614 and the radius of the cam arc 611 or 612 will determine the maximum radius of simultaneous engagement relative to the crank length. This is the maximum radius through which the shaft may pass with clearance to rotate and also the minimum lever arm creating a force between arc cams 611, 612 and straight cams 621, 622 as measured from or eccentric bearing center 63. When the maximum angle between cam arc centers 613, 614 measured from shaft longitudinal canter 61 is decreased for example by having more cam arcs 611, 612, the length for which the straight cam surfaces 621, 622 need to extend radially toward the hole 51 center decreases. The effect of introducing an angle gamma between arc centers less than 180 degrees is that the minimum radius of engagement or hole 51 is larger for a given rotor frontal area. The effect is also for shaft 60 to have less material removed for clearance with hole 51 and thus be stronger. Although further embodiments having an increased number of guide cams 611, 612 with twice as many straight cams 621, 622 provided are possible, not much more advantage in increased hole size 51, minimum radius of engagement 51, or shaft 60 strength is gained.

Figure 7B:
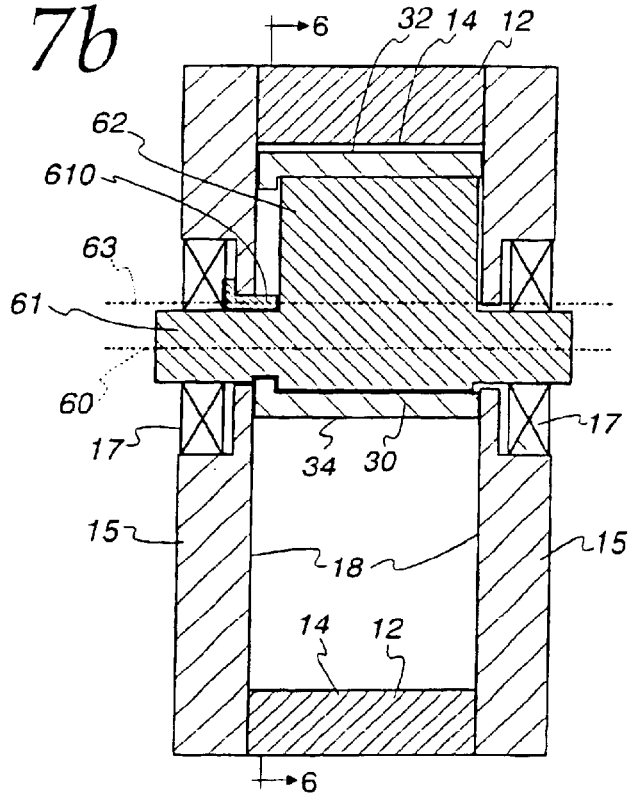
FIG. 7*b* is a cross-sectional view taken along the line 7*b*—7*b* of FIG. 6.
Figure 7A:
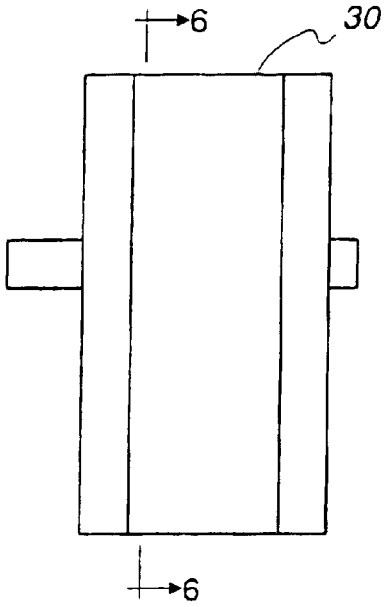
FIG. 7*a* is an elevational view of a further embodiment of a rotary machine according to principles of the present invention.

FIG. 7 shows an axial view of the third embodiment and demonstrates the shaft can be much larger and hence stronger in the passage through hole 51 for the same crank length.

Figure 8:
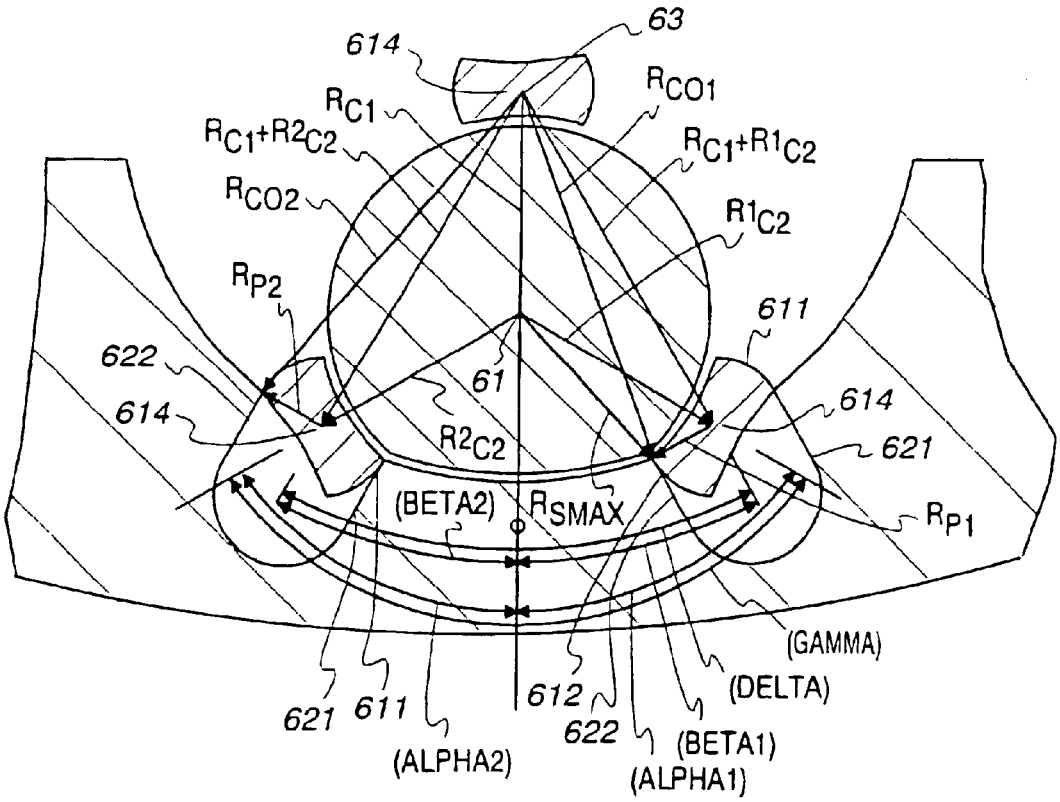
FIG. 8 is a fragmentary view of FIG. 6 taken on an enlarged scale.

FIG. 8 shows an enlarged view of the six-arc cam and twelve-straight cam embodiment of FIG. 2. As shown in this figure, $R_{C0}$ is the minimum radius of simultaneous engagement or radius of the area 51 in that plane measured from the eccentric bearing center 63. It should be noted that this is not in line with the arc cam center 614 for variations of this embodiment where arc cams 611,612 are not equally spaced around the shaft longitudinal axis 611 or have different radii. $R1_{C0}$ and $R2_{C0}$ are the distances from the eccentric bearing center 63 to the point of engagement of cam arc 612 and straight cam 622. A similar description would follow for cam set 611, 621, however cam set 612, 622 will be described. The minimum radius of engagement for the leading or trailing cam set being $R_{C0}$ is when $R1_{C0}$ and $R2_{C0}$ are equal. There are various techniques to solve for the minimum $R_{C0}$ from the vectors defining the geometry. $R_{C1}$ is the vector between eccentric bearing center 63 and the shaft longitudinal center 61, this is the crank length of the rotary machine. $R1_{C2}$ and $R2_{C2}$ are vectors between the shaft longitudinal center 61 and the applicable cam arc center 614 and these vectors are fixed. The radii $R_{P1}$ and $R_{P2}$ of the cam arcs 612 as shown in FIG. 5 are equal, however in a general formulation these are not assumed equal. Alpha1 is the angle between the vector $R1_{C2}$ and $R_{C1}$. Alpha2 is the angle between $R2_{C2}$ and $R_{C1}$. Alpha1 plus Alpha2 is the angle between $R1_{C2}$ and $R2_{C2}$ defined as gamma. Beta1 can be defined as the angle between the vector ($R_{C1}$+$R1_{C2}$) and $R_{C1}$. Beta2 is defined as the angle between ($R_{C1}$+$R2_{C2}$) and $R_{C1}$. Beta1 plus beta2 is the angle delta between the straight cams 622. The straight cams 622 having the greatest angle delta to one another correspond to the minimum $R_{C0}$ for the configuration. These values have the following relationship:

$$\alpha 1 = 2\cdot\beta 1$$

$$\alpha 2 = 2\cdot\beta 2$$

$$\chi = \alpha 1 + \alpha 2$$

$$\delta = \beta 1 + \beta 2$$

and;

$$|R_{C1}| = |R1_{C2}| = |R2_{C2}|$$

and $R_{CO1}$=and $R_{CO2}$ are;

$$|R_{CO1}| = \sqrt{R_{C1}^2 + R1_{C2}^2 - 2R_{C1}R1_{C2}\cos(180-\alpha 1) + R_{P1}^2}$$

$$|R_{CO2}| = \sqrt{R_{C1}^2 + R2_{C2}^2 - 2R_{C1}R2_{C2}\cos(180-\alpha 2) + R_{P2}^2}$$

The minimum simultaneous engagement radius is when $R_{CO1}$ equals $R_{CO2}$. For the case where $R_{P1}$ equals $R_{P2}$ it can be shown that alpha1 equals alpha2, which is half the angle between arc cam centers 614 measured from the shaft longitudinal center 61. The minimum engagement radius $R_{CO}$ then becomes;

$$|R_{CO1}| = \sqrt{R_{C1}^2 + R1_{C2}^2 - 2R_{C1}R1_{C2}\cos(180 - 1/2\chi) + R_{P1}^2}$$

If $R_{P1}$ and $R_{P2}$ of the arc cams 612 are not equal then equating $R_{CO1}$ and $R_{CO2}$ allows for the determination of alpha1 and alpha2. This can be accomplished in closed form or by iteration by several mathematical methods. The value of $R_{CO}$ is found by substituting the corresponding value found for alpha1 or alpha2 in the formula for $R_{CO1}$ or $R_{CO2}$.

Furthermore, the maximum radius of the shaft 60 is represented by $R_{smax}$ wherein:

$$|R_{smax}| = \sqrt{R1_{C2}^2 + R_{P1}^2 - 2R1_{C2}R_{P1}\cos(90-\beta 1)}$$

is the $R_{smax}$ parameter for a shaft passing through that plane of the cam set. In other words, $R_{smax}$ is constrained by the spacing of the slots, the largest spacing being at an angle delta, and the shaft 60 may only be so large to allow unrestricted engagement of the cam arcs 612 with the straight cams 622. When the radius $R_s$ of the shaft 60 is:

$$R_{CO}-R_{smax} \leqq R_S \leqq R_{smax}$$

is a very small cutaway portion is needed on the shaft 60 so that the shaft 60 is no longer perfectly cylindrical.

This type of configuration provides for a durable mechanism while allowing a shaft diameter that is larger than what would be possible if a gear or slots at right angles were used, thus allowing for a greater torque handling capability. The minimum engagement radius being larger for a given stroke also means the maximum contact velocity of the cam surfaces is lower and the moment arm from the rotor center is greater reducing contact force. This can be significant for rapid angular acceleration of the rotor that can create significant interaction forces on the cam surfaces.

While this preferred embodiment of the invention shows the guide cams 611, 612 arranged symmetrically about the eccentric bearing center 63 of the rotor assembly, there is no requirement that either the guide cams 611, 612 or the straight cams 621, 622 be evenly spaced. Furthermore, it was demonstrated that there is no requirement that the guide cams 611, 612 all be of a uniform radius.

Figure 9:
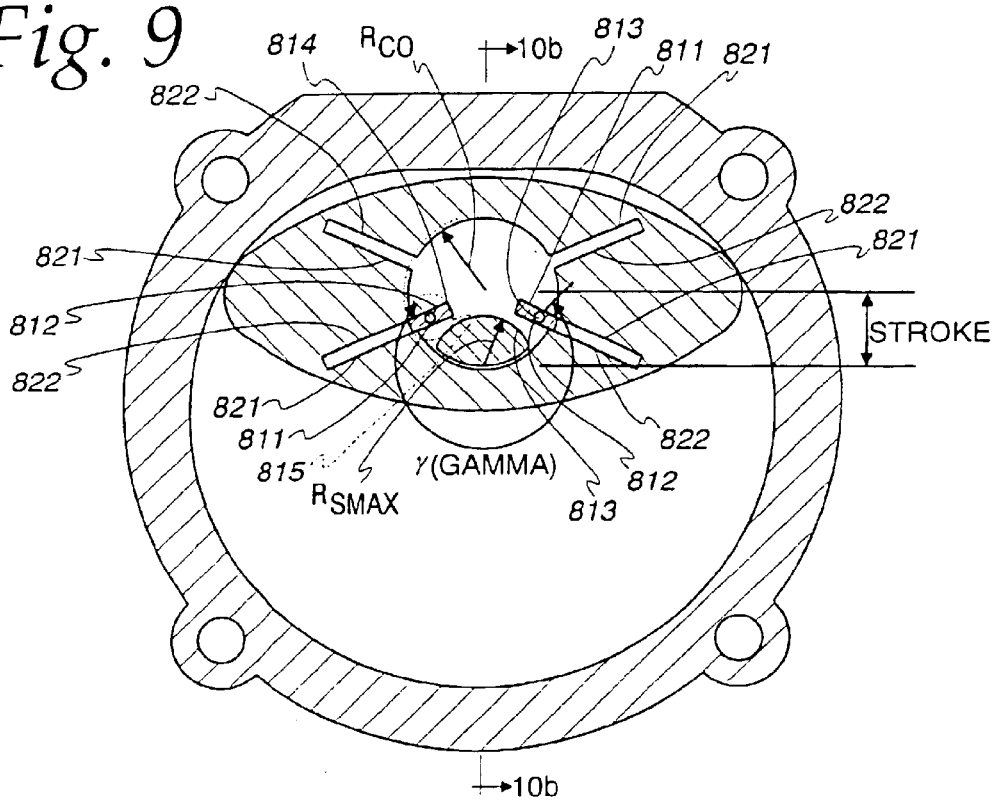
FIG. 9 is a cross-sectional view taken along the line 9—9 of FIG. 10*a;*

FIG. 9 shows an embodiment having straight sliding cam surfaces 811, 812 rotating on a bearing center 814 centered at the position of a cam arc center 714 of the second embodiment of FIG. 3. There are four rotating slider-cam surfaces 811, 812 and eight straight cams 821 and 822, however, the edge of the slider must clear the shaft as determined by the path of the edge of the rotating slider 815.

Figure 10B:
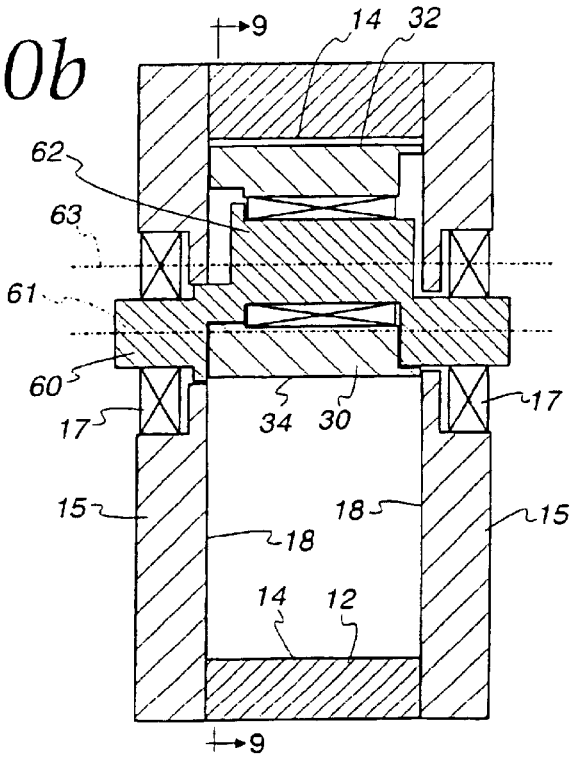
FIG. 10*b* is a cross-sectional view taken along line 10*b*—10*b* of FIG. 9.
Figure 10A:
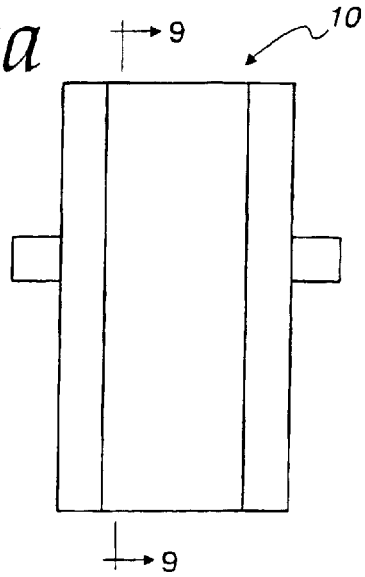
FIG. 10*a* is a side elevational view of another rotary machine according to principles of the present invention.

FIG. 10 shows the portion of the shaft 60 passing through the hole 51 being larger and hence stronger than the comparable second embodiment shown in FIG. 4.

Figure 11:
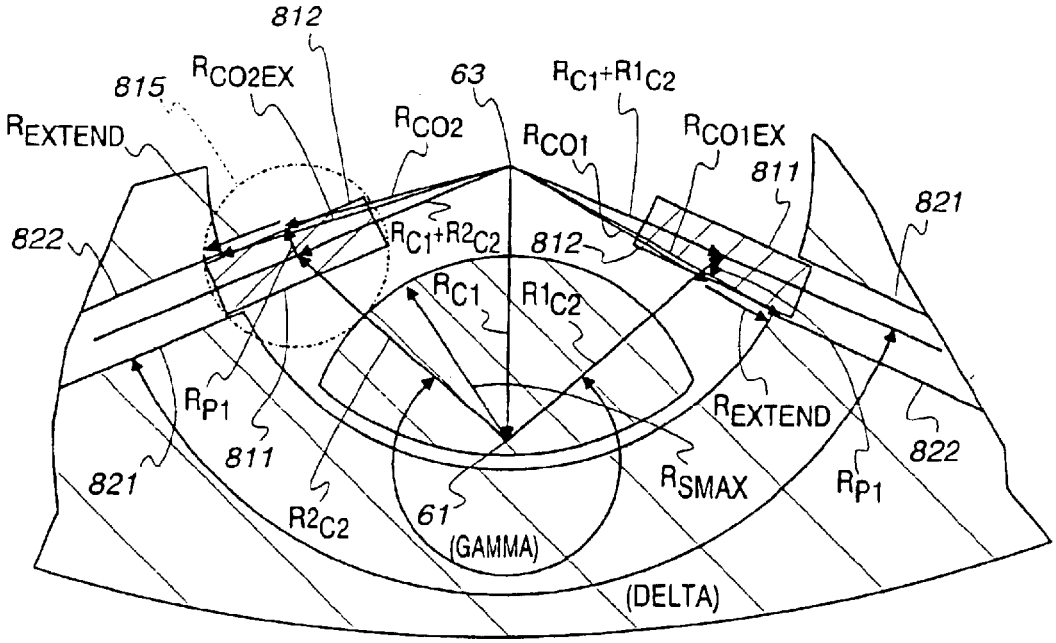
FIG. 11 is a fragmentary view of FIG. 9 taken on an enlarged scale.

FIG. 11 shows the vectors describing the minimum radius of simultaneous engagement that is at the end of the sliding contact. An additional vector $R_{Extend}$ is added to the $R_{CO1}$ determined by using the same method as previously described except $R_{P1}$ is now the distance of the straight cam surface from the center of the slider cam bearing center 814.

$$R_{CO1} = \sqrt{R_{C1}^2 + R1_{C2}^2 - 2R_{C1}R1_{C2}\cos(180-\alpha 1) + R_{P1}^2}$$

and;

$$\vec{R}_{CO1Ex} = \sqrt{R_{C1}^2 + R1_{C2}^2 - 2R_{C1}R1_{C2}\cos(180-\alpha 1) + R_{P1}^2}\left(\frac{\vec{R}_{CO1}}{R_{CO1}}\right) + \vec{R}_{Extend}$$

It should be noted that the vector $R_{Extend}$ could be directed toward the rotor center. Since the slider-cam surfaces 811, 812 rotate about a bearing center 814. The slider-cam surfaces 811, 812 must by some means be oriented for reengagement with the rotor straight cams 821, 822. These rotating slider-cam surfaces 811, 812 can also provide for additional input/output from the device that rotates at half the rpm of the shaft 60. For example, the slider could be coupled to another rotor that is 180 degrees out of phase in another stage. Something of this nature could even be for balance and providing an action similar to a flywheel. The $R_{smax}$ is in this case the crank length minus the radius of the path of the edge of the slider cam surface 815.

Figure 12:
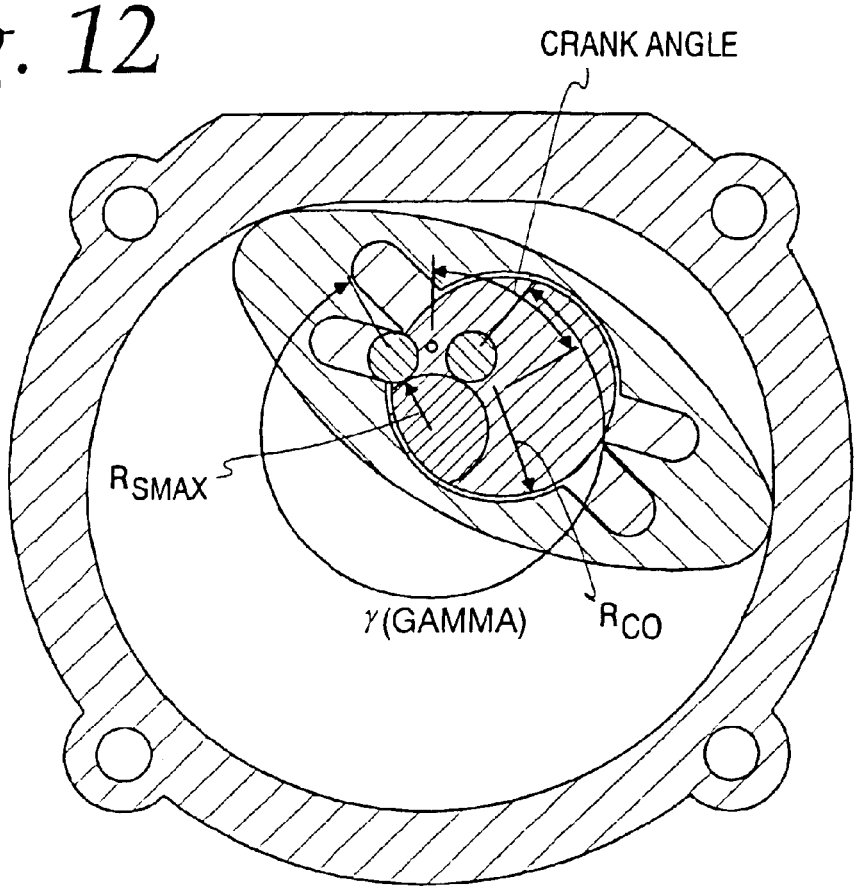
FIG. 12 is a cross-sectional view similar to that of FIG. 3 but showing an alternative rotor assembly.

FIG. 12 shows yet another embodiment of the present invention, similar to that shown in FIG. 3. The rotor 30 is shown rotated at an angle of 30 degrees in this figure for demonstrative purposes only. In this embodiment, however, the straight cams 721, 722 are such that there is a portion of the stroke where there is not a continuous engagement with the guide cams. This allows for an even larger hole than that defined with a radius of $R_{CO}$. The rotor apexes maintain alignment of the rotor for that portion of the stroke. This is significant in that as the angle between the straight cams 721, 722 extending in a direction toward an apex 36, 38 decrease, the guide cam minimum radius $R_{CO}$ of engagement decreases. A torque or moment about the rotor center would produce a force interaction that would then increase as the distance $R_{CO}$ from the center decreases. A larger and stronger shaft 60 may be used and in many applications the rotor apex maintaining alignment for this portion of the stroke is a more durable configuration. This embodiment has a desirable characteristic being that the constant rotational speed condition with an even pressure distribution on the rotor surface will not cause any force on the apex 36, 38 to develop. The radius of engagement for this position would still be;

$$R_{CO1} = \sqrt{R_{C1}^2 + R1_{C2}^2 - 2R_{C1}R1_{C2}\cos(180-\alpha 1) + R_{P1}^2}$$

and;

$$R_{CO2} = \sqrt{R_{C1}^2 + R2_{C2}^2 - 2R_{C1}R2_{C2}\cos(180-\alpha 2) + R_{P2}^2}$$

however the actual maximum radius of simultaneous engagement $R_{CO}$ for either of the cam contact points is found when the guide cams 711, 712 come out of contact with the straight cams 721, 722.

FIG. 13 shows an embodiment having cams of different radii but being concentric.

Figure 14:
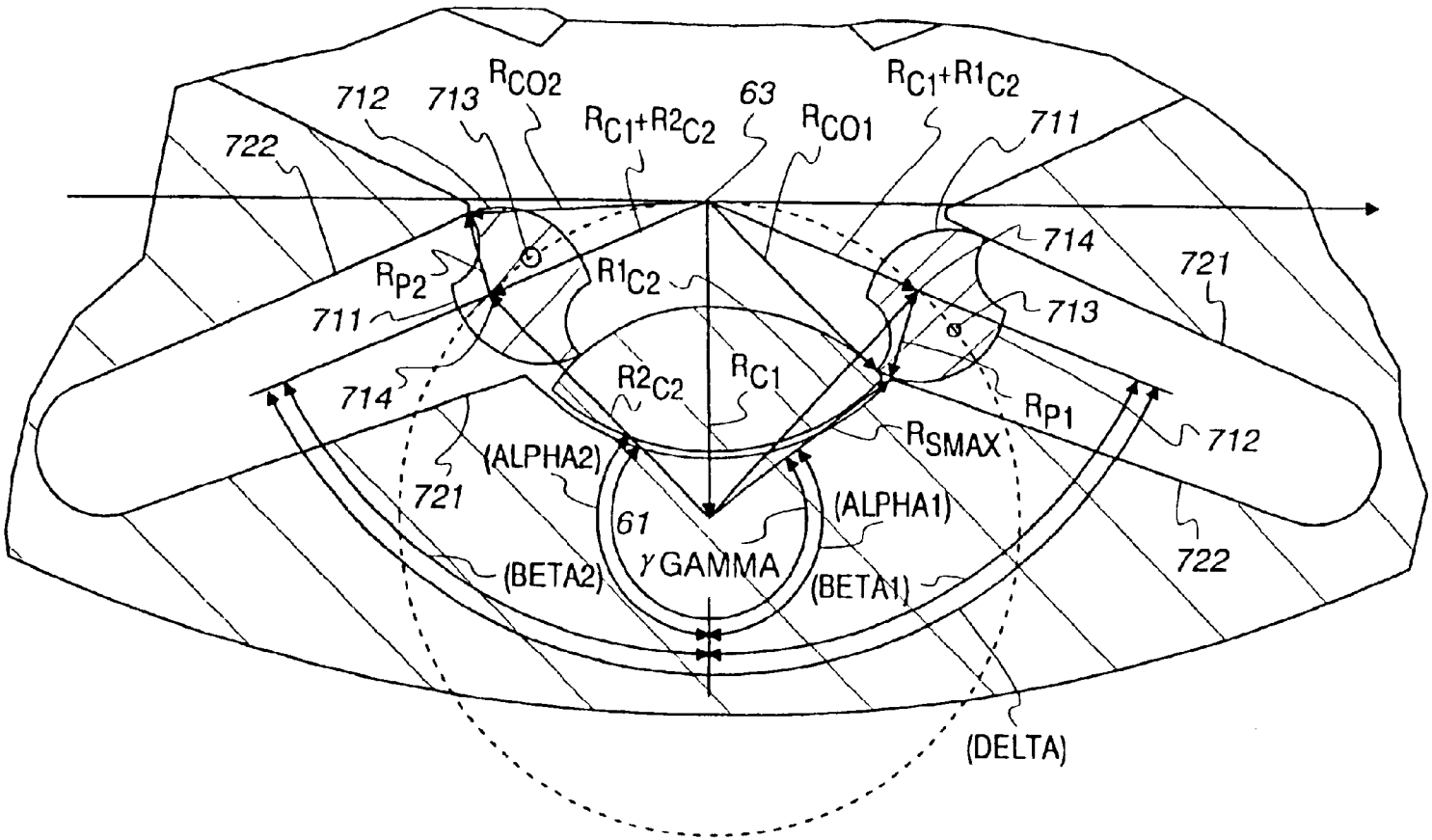

FIG. 14 shows an embodiment where two cam arcs 711, 712 of opposite radial orientation are mounted having different cam arc centers 713, 714. The opposing cam arcs appear in part lenticular or elliptical, and the opposing straight cams 721, 722 converge together.

Generally, it is easiest to manufacture a cam arc that is cylindrical or semi-cylindrical in shape over the entire cross section of the cam arc. The arc cams however do not necessarily need to maintain a circular cross-sectional shape over that portion of the guide cam surface that engages with the slots.

Figure 15:
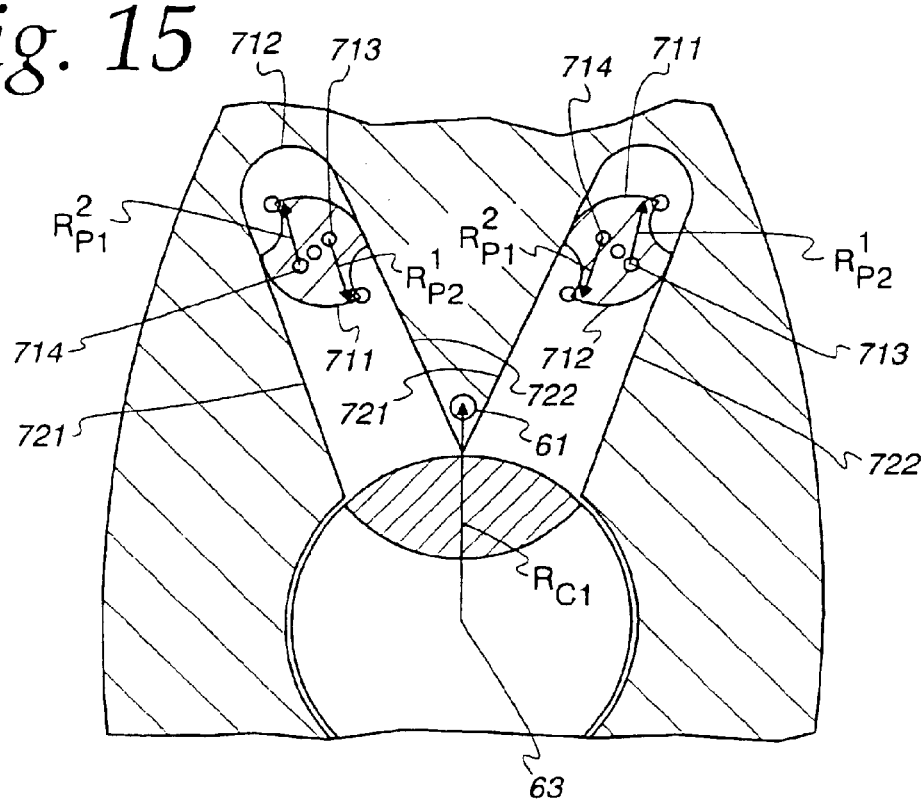
Figure 16:
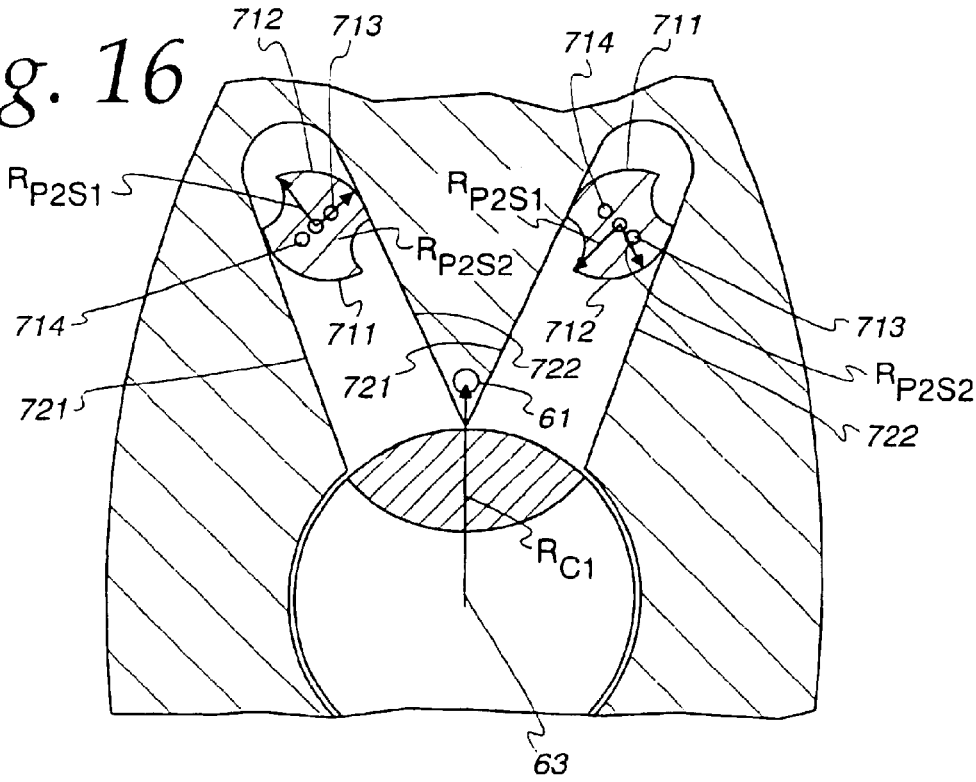

FIG. 15 has an identical geometric configuration to FIG. 16 displaying a center spiraling inward.

As shown in FIG. 16, kit is also possible for an embodiment to have each segment in each perpendicular bisecting plane, which defines cam arcs 711, 712 to have a differing radii $R_P$ which cause a cam surface that spirals inward. FIG. 16 is also a special case of the embodiment shown in FIG. 14 and FIG. 15 but described geometrically with different reference to the cam arc centers 713, 714.

In this configuration the opposing straight cams 721, 722 converge together and could even be curved. The effect is an infinite number of straight cams and cam arcs in a plane perpendicular to the shaft longitudinal axis. The inner most simultaneous engagement surface will still have the same relation as previously described depending on the $R_P$ of said cam arc 711, 722 and "gamma" at that position.

$$R_{CO1} = \sqrt{R_{C1}^2 + R1_{C2}^2 - 2R_{C1}R1_{C2}\cos(180-\alpha 1) + R_{P1}^2}$$

-continued $$R_{CO2} = \sqrt{R_{C1}^2 + R2_{C2}^2 - 2R_{C1}R2_{C2}\cos(180 - \alpha 2) + R_{P2}^2}$$

and $R_{smax}$ is;

$$|R_{\text{smax}}| = \sqrt{R2_{C2}^2 + R_{P2}^2 - 2R2_{C2}R_{P2}\cos(90 - \beta 2)}$$

In general for any configuration in which the guideposts are conical or are not of uniform radius in a perpendicular plane, calculations for the minimum radius of engagement and maximum shaft radius must be calculated over the entire longitudinal length of the guide cams.

Figure 19:
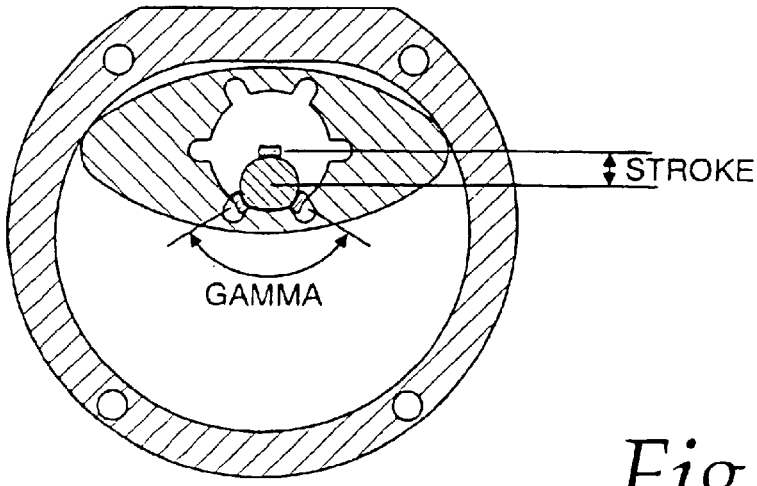
FIG. 19 is a cross-sectional view similar to that of FIG. 6 but showing an arrangement with equal stroke.
Figure 17:
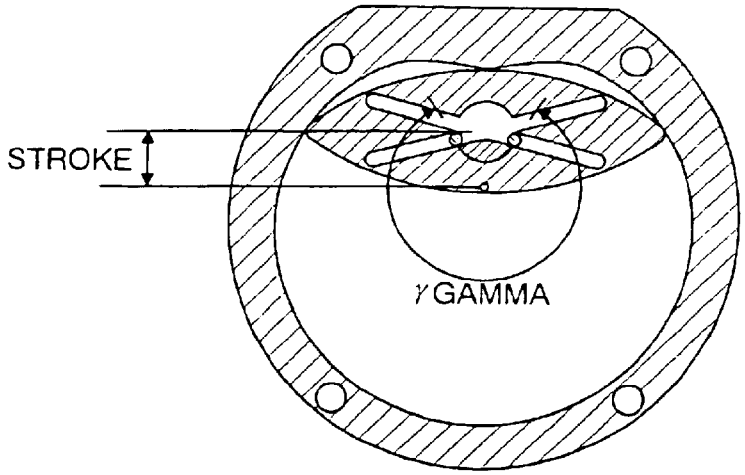
FIG. 17 is a cross-sectional view similar to that of FIG. 2*a* but showing an arrangement with equal stroke.
Figure 18:
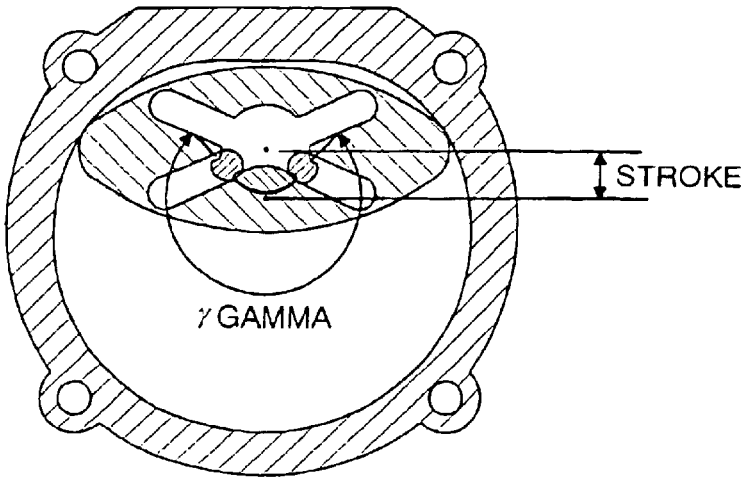
FIG. 18 is a cross-sectional view similar to that of FIG. 3 but showing an arrangement with equal stroke.

FIG. 17, FIG. 18 and FIG. 19 are three of the before mentioned embodiments drawn with like stroke or crank length. The passage of the shaft through hole 51 is smaller as gamma increases however the shaft cutout portion, as it has hereto been referred to, is further from the shaft longitudinal axis which reduces the torsional stresses in that portion of the shaft. The minimum distance of cam interaction from the eccentric bearing longitudinal center can be of greater concern due to increased contact forces and contact velocities closer to the rotor center.

Although the invention has been described relative to specific embodiments thereof, there are numerous variations and modifications that will be readily apparent to those skilled in the art in the light of the above teachings. It is therefore to be understood that, within the scope of the appended claims, the invention may be practiced other than as specifically described.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A rotary machine comprising:

a housing with spaced apart end walls for defining a chamber;

a two-lobe elliptical or lenticular rotor assembly having curved faces meeting at symmetrically opposed apices, said rotor assembly having two parallel end faces extending between said curved faces, each of said parallel end faces facing one of said end walls, said rotor assembly disposed in said chamber for eccentric rotation therein, said rotor assembly further having an even number of eight or more straight cams in at least one of said parallel end faces arranged about a center of said rotor assembly, each of said straight cams defining an edge ending at a distance from said rotor center;

a rotor guide assembly extending from at least one of said end walls, said rotor guide assembly including four or more arc cams, each of said four or more arc cams being cylindrical in shape over a portion thereof, each of said four or more arc cams having a radius $R_p$ over said portion, each of said four or more arc cams extending through at least one of said parallel end faces having said straight cams, said four or more arc cams engaging said straight cams during said eccentric rotation of said rotor assembly, each of said arc cams having a center longitudinal axis;

a shaft having a center longitudinal axis, said center longitudinal axis of said shaft being offset from said center of said rotor assembly by an offset distance $R_{C1}$, said shaft extending through said chamber and rotatably mounted in one or both of said endwalls, said shaft further being centered between said four or more arc cams such that the distance $R_{C2}$ of said center longitudinal axis of said shaft to each of said center longitudinal axis of said four or more arc cams is equal to said offset distance $R_{C1}$, said shaft including at least one eccentric bearing for forming driving contact between said shaft and said rotor assembly, said eccentric bearing having longitudinal center passing through said center of said rotor assembly;

a point of engagement of each of said arc cams with either of two engaging straight cams of said eight or more straight cams, said point of engagement having distance from said center of said rotor assembly, said point of engagement having a rotor assembly position, said rotor assembly position having an angle (180–α) between said center of said rotor assembly to said arc cam center longitudinal axis measured from said shaft center longitudinal axis, said point of engagement having said distance from said center of said rotor assembly equal to $$\sqrt{R_{C1}^2 + R1_{C2}^2 - 2R_{C1}R1_{C2}\cos(180 - \alpha) + R_P^2}.$$

2. The rotary machine as claimed in claim 1, wherein said arc cams are generally cylindrical in shape.

3. The rotary machine of claim 1 further comprising:

a region adjacent said eight or more straight cams, said region having a minimum radius of simultaneous engagement measured from said center of said rotor assembly, said radius being defined by two adjacent leading arc cams or adjacent trailing arcing cams of said arc cams, said two arc cams having a first in line arc cam and second in line arc cam, said two adjacent arc cams having an angle (χ) between said center longitudinal axis of said two adjacent arc cams measured from said shaft center longitudinal axis, said angle (χ) being the maximum for any two adjacent leading arc cams or trailing arc cams, said angle (χ) being greater than 180 degrees, said minimum radius of simultaneous engagement being said distance of engagement of the said second in line of said two adjacent arc cams and said distance of engagement of said first in line of said two adjacent arc cams when equal, said rotor having position for said minimum radius of simultaneous engagement, said position having an angle (180–α1m) between said center of said rotor assembly to said second in line of two adjacent arc cams center longitudinal axis measured from said shaft center longitudinal axis, said position having an angle (180–α2 m) between said center of said rotor assembly to said first in line of two adjacent arc cams center longitudinal axis, said minimum radius of simultaneous engagement is equal to $$\sqrt{R_{C1}^2 + R1_{C2}^2 - 2R_{C1}R1_{C2}\cos(180 - \alpha 1m) + R_{P1}^2}.$$

4. The rotary machine of claim 3 wherein:

said minimum radius of simultaneous engagement is also equal to $$\sqrt{R_{C1}^2 + R1_{C2}^2 - 2R_{C1}R1_{C2}\cos(180 - \alpha 2m) + R_{P2}^2}\ .$$

5. The rotary machine of claim 3 wherein:

said minimum radius of engagement for said arc cams of equal radius is equal to $$\sqrt{R_{C1}^2 + R1_{C2}^2 - 2R_{C1}R1_{C2}\cos(180 - 1/2\chi) + R_{P1}^2}\ .$$

6. The rotary machine of claim 5 further comprising:

an edge of said second in line arc cam of said two arc cams of said leading or trailing set of arc cams, said edge containing a contact point between arc cam and straight cam at minimum radius of simultaneous engagement, said edge being a distance $R_{smax}$ from said shaft center longitudinal axis, said distance $R_{smax}$ from shaft longitudinal center is equal to $$\sqrt{R_{C2}^2 + R_{P1}^2 - 2R_{C2}R_{P1}\cos(90 - \alpha 1m/2)}\ .$$

7. The rotary machine as claimed in claim 6, further comprising a hole passing through the central portion of the rotor assembly and said parallel end faces;

wherein said shaft extends through said hole and said chamber, and is rotatably mounted in each of said end walls; and wherein said hole is sized so that a distance between said rotor assembly center longitudinal axis to each of said two edges for each of said open ends of said slots is less than a minimum radius of simultaneous engagement equal to $$\sqrt{R_{C1}^2 + R_{C2}^2 - 2R_{C1}R_{C2}\cos(180 - \alpha 1m) + R_{P1}^2}\ .$$

8. The rotary machine of claim 7 wherein:

the maximum radius of said shaft is less than $$\sqrt{R_{C2}^{2+R_{P1}2-2R_{smax}\ldots}}.$$

9. The rotary machine as claimed in claim 8, further comprising a cutout portion in said shaft to provide clearance for said shaft to extend through the hole in said rotor assembly.

10. The rotary machine as claimed in claim 8, wherein said arc cams are shaped to provide rotational clearance for said shaft.

11. The rotary machine as claimed in claim 8, wherein said shaft is cylindrical in shape except for a portion adjacent said eccentric bearing.

12. The rotary machine as claimed in claim 1, wherein said arc cams are cylindrical bearings.

13. The rotary machine as claimed in claim 12, wherein each of said cylindrical bearings include two or more rollers longitudinally aligned and mounted on a roller shaft.

14. The rotary machine as claimed in claim 1, wherein said arc cams comprise rotatably mounted straight sliders.

15. The rotary machine as claimed in claim 14, wherein said straight sliders are positioned for engagement with said straight cams.

16. A rotary machine comprising:

a housing with spaced apart end walls for defining a chamber;

a two-lobe elliptical or lenticular rotor assembly having curved faces meeting at symmetrically opposed apices, said rotor assembly having two parallel end faces extending between said curved faces, each of said parallel end faces facing one of said end walls, said rotor assembly disposed in said chamber for eccentric rotation therein, said rotor assembly further having an even number of twelve or more straight cams in at least one of said parallel end faces arranged about a center of said rotor assembly, each of said straight cams defining an edge ending at a distance from said rotor center;

a rotor guide assembly extending from at least one of said end walls, said rotor guide assembly including six or more arc cams, each of said six or more arc cams being cylindrical in shape over a portion thereof, each of said six or more arc cams having a radius $R_p$ over said portion, each of said six or more arc cams extending through at least one of said parallel end faces having said straight cams, said six or more arc cams engaging said straight cams during said eccentric rotation of said rotor assembly, each of said arc cams having a center longitudinal axis;

a shaft having a center longitudinal axis, said center longitudinal axis of said shaft being offset from said center of said rotor assembly by an offset distance $R_{C1}$, said shaft extending through said chamber and rotatably mounted in one or both of said endwalls, said shaft further being centered between said six or more arc cams such that the distance $R_{C2}$ of said center longitudinal axis of said shaft to each of said center longitudinal axis of said six or more arc cams is equal to said offset distance $R_{C1}$, said shaft including at least one eccentric bearing for forming driving contact between said shaft and said rotor assembly, said eccentric bearing having longitudinal center passing through said center of said rotor assembly;

a point of engagement of each of said arc cams with either of two engaging straight cams of said twelve or more straight cams, said point of engagement having a distance from said center of said rotor assembly, said point of engagement having rotor assembly position, said rotor assembly position having an angle (180–α) between said center of said rotor assembly to said arc cam center longitudinal axis measured from said shaft center longitudinal axis center, said point of engagement having said distance from said center of said rotor assembly equal to $$\sqrt{R_{C1}^2 + R1_{C2}^2 - 2R_{C1}R1_{C2}\cos(180 - \alpha) + R_P^2}\ .$$

17. The rotary machine of claim 16 further comprising:

a region adjacent an area of said twelve or more straight cams, said region having a minimum radius of simultaneous engagement measured from said center of said rotor assembly, said radius being defined by two adjacent leading arc cams or adjacent trailing arc cams of said arc cams, said two arc cams having a first in line arc cam and second in line arc cam, said two adjacent arc cams having an angle (χ) between said center longitudinal axis of said two adjacent arc cams measured from said shaft center longitudinal axis, said angle (χ) being the maximum for any two adjacent leading arc cams or trailing arc cams, said angle (χ) being less than 180 degrees, said minimum radius of simultaneous engagement being said distance of engagement of the said second in line of said two adjacent arc cams and said distance of engagement of said first in line of said two adjacent arc cams when equal, said rotor having position for said minimum radius of simultaneous engagement, said position having angle (180–$\alpha 1m$) between said center of said rotor assembly to said second in line of two adjacent arc cams center longitudinal axis measured from said shaft center longitudinal axis, said position having angle (180–$\alpha 2m$) between said center of said rotor assembly to said first in line of two adjacent arc cams center longitudinal axis, said minimum radius of simultaneous engagement is equal to $$\sqrt{R_{C1}^2 + R1_{C2}^2 - 2R_{C1}R1_{C2}\cos(180 - \alpha 1m) + R_{P1}^2}\ .$$

18. The rotary machine of claim 17 wherein:

said minimum radius of simultaneous engagement is also equal to $$\sqrt{R_{C1}^2 + R1_{C2}^2 - 2R_{C1}R1_{C2}\cos(180 - \alpha 2m) + R_{P2}^2}\ .$$

19. The rotary machine of claim 19 wherein:

said minimum radius of engagement for said arc cams of equal radius is equal to $$\sqrt{R_{C1}^2 + R1_{C2}^2 - 2R_{C1}R1_{C2}\cos(180 - 1/2\chi) + R_{P1}^2}\ .$$

20. The rotary machine of claim 19 further comprising:

an edge of said second in line arc cam of said two arc cams of said leading or trailing set of arc cams, said edge containing a contact point between arc cam and straight cam at minimum radius of simultaneous engagement, said edge being a distance $R_{smax}$ from said shaft center longitudinal axis, said distance $R_{smax}$ from shaft longitudinal center is equal to $$\sqrt{R_{C2}^2 + R_{P1}^2 - 2R_{C2}R_{P1}\cos(90 - \alpha 1m/2)}\ .$$

21. The rotary machine as claimed in claim 20, with said hole passing through the central portion of the rotor assembly and said parallel end faces;

wherein said shaft extends through said hole and said chamber, and is rotatably mounted in each of said end walls; and wherein said hole is sized so that a distance between said rotor assembly center longitudinal axis to each of said two edges for each of said open ends of said slots is less than said minimum radius of simultaneous engagement equal to $$\sqrt{R_{C1}^2 + R_{C2}^2 - 2R_{C1}R_{C2}\cos(180 - \alpha 1m) + R_{P1}^2}$$

and the maximum radius of said shaft is less than $$\sqrt{R_{C2}^2 + R_{P1}^2 - 2R_{C2}R_{P1}\cos(90 - \alpha 1m/2)}\ .$$

22. The rotary machine as claimed in claim 21, further comprising a cutout portion in said shaft to provide clearance for said shaft to extend through the hole in said rotor assembly.

23. The rotary machine as claimed in claim 21, wherein said arc cams are shaped to provide rotational clearance for said shaft.

24. The rotary machine as claimed in claim 21, wherein said arc cams are generally cylindrical in shape.

25. The rotary machine as claimed in claim 21, wherein said shaft is cylindrical in shape except for a portion adjacent said eccentric bearing.

26. The rotary machine as claimed in claim 21, wherein said arc cams are cylindrical bearings.

27. The rotary machine as claimed in claim 26, wherein each of said cylindrical bearings include two or more rollers longitudinally aligned and mounted on a roller shaft.

28. The rotary machine as claimed in claim 16, wherein said arc cams comprise rotatably mounted straight sliders.

29. The rotary machine as claimed in claim 28, wherein said straight sliders are positioned for engagement with said straight cams.

* * * * *

UNITED STATES PATENT AND TRADEMARK OFFICE

CERTIFICATE OF CORRECTION

PATENT NO. : 6,799,955 B1
APPLICATION NO. : 10/628658
DATED : October 5, 2004
INVENTOR(S) : Joseph A. Sbarounis It is certified that error appears in the above-identified patent and that said Letters Patent is hereby corrected as shown below:

Column 13, line 43, delete the equation " $\sqrt{R_{C2}^2+R_{P1}^2-2R_{\ldots}}$ " and insert -- $\sqrt{R_{C2}^2 + R_{P1}^2 - 2R_{C2}R_{P1}\cos(90 - \alpha 1m/2)}$ . -- therefor.

Column 15, line 23, delete "claim 19" and insert --claim 18-- therefor.

Signed and Sealed this

Twenty-fourth Day of July, 2007

JON W. DUDAS
*Director of the United States Patent and Trademark Office*